US007802366B2

(12) United States Patent
Boerner

(10) Patent No.: US 7,802,366 B2
(45) Date of Patent: Sep. 28, 2010

(54) INSERT FOR A SLICER

(75) Inventor: Juergen Boerner, Landscheid-Niederkail (DE)

(73) Assignee: Boerner Kunststoff-und Metallwarenfabrik GmbH, Landscheid-Niederkail (DE)

( * ) Notice: Subject to any disclaimer, the term of this patent is extended or adjusted under 35 U.S.C. 154(b) by 0 days.

(21) Appl. No.: 11/701,866

(22) Filed: Feb. 1, 2007

(65) Prior Publication Data

US 2007/0207657 A1 Sep. 6, 2007

Related U.S. Application Data

(63) Continuation of application No. PCT/EP2005/008053, filed on Jul. 7, 2005.

(30) Foreign Application Priority Data

Aug. 2, 2004 (DE) ..... 10 2004 038 815

(51) Int. Cl.
*B26B 3/00* (2006.01)

(52) U.S. Cl. ..... 30/122; 30/278; 83/856

(58) Field of Classification Search ..... 83/856, 83/699.51; 439/368; 30/122, 278, 304, 286, 30/279.2; 99/537; 241/100
See application file for complete search history.

(56) References Cited

U.S. PATENT DOCUMENTS 4,290,196 A * 9/1981 Borner ..... 30/122
7,066,071 B2 * 6/2006 Zeder et al. ..... 83/698.11
2004/0031158 A1 * 2/2004 Boerner ..... 30/286

FOREIGN PATENT DOCUMENTS

| | | |
|---|---|---|
| DE | 100 54 174 | 6/2002 |
| DE | 10328506 B4 | 5/2005 |
| EP | 1 264 669 | 12/2002 |
| EP | 1264669 | 12/2002 |
| EP | 1 410 883 | 4/2004 |
| WO | 2006/015712 | 2/2006 |

OTHER PUBLICATIONS

International Search Report for PCT/EP2005/008053, filed Jul. 23, 2005.
International Preliminary Report on Patentability for PCT/EP2005/008053, filed July 23, 2005.

* cited by examiner

*Primary Examiner*—Ghassem Alie
(74) *Attorney, Agent, or Firm*—Klarquist Sparkman, LLP

(57) ABSTRACT

A reversal insert for a slicer for chopping up items such as fruit, vegetables, etc. has a base plate, of which one side is designed as a bearing surface. In a first reversal position of the insert the item can be guided longitudinally on the bearing surface onto a cutting edge of a blade of the slicer. The insert includes first fastening elements in order for the insert to be secured on a basic body of the slicer in the first reversal position, and second fastening elements in order for the insert to be secured on the basic body in a second reversal position. The second fastening means are arranged such that, in the second reversal position, the insert covers the cutting edge of the blade from above.

11 Claims, 2 Drawing Sheets

14'
52
54
23
50
50
46
58
41
44
IV
IV

14'
52
54
56
50
24
26
46
58
23
41
36
44
60
44
62

INSERT FOR A SLICER

CROSS-REFERENCE TO RELATED APPLICATIONS

This is a Continuation application of International patent application PCT/EP2005/008053, filed Jul. 7, 2005 and claiming priority of German patent application DE 10 2004 038 815, filed Aug. 2, 2004.

BACKGROUND

The present invention relates to a reversible insert for a slicer for chopping up items such as fruit, vegetables, etc., having a base plate, of which one side is designed as a bearing surface in order, in a first reversal position of the insert, for the item to be guided longitudinally on this surface onto a cutting edge of a blade of the slicer, having first fastening means in order for the insert to be secured on a basic body of the slicer in the first reversal position, and having second fastening means in order for the insert to be secured on the basic body in a second reversal position.

The present invention also relates to a slicer having such an insert.

Such a reversible insert for a slicer is known, for example, for the so-called V-slicer of the present applicant (see "Trend-Line" model on www.boerner-germany.de).

A slicer serves for chopping up items such as fruit, vegetables, etc. In this case, the item is generally guided, on a bearing surface, onto a blade. Situated behind the blade is a run-off surface on which the leftover portion of the item "runs off". Cut-off slices drop downward from the underside of the slicer. Particularly good cutting results can be achieved using the abovementioned V-slicer.

In the case of the abovementioned "Trendline" model of the V-slicer, an insert can be secured on a basic body in a first reversal position and a second reversal position, i.e., in a state in which it has been rotated through 180°. The basic body bears the blade and forms the run-off surface. The insert forms the bearing surface, on which the item is guided onto the blade. Reversal of the insert here changes the cutting thickness.

In the case of a further slicer ("V4" model on www-.boerner-germany.de), an insert is likewise mounted on a basic body. For cutting-thickness adjustment, however, the insert can be adjusted, as a whole, into a plurality of latching positions on the basic body without having to be reversed.

One problem with slicers is that of safety, since the blades used are very sharp. During a cutting operation, use is often made of a so-called fruit holder, which excludes the risk of the user injuring himself or herself on the blade during cutting. A not insignificant risk is also posed, however, when the slicer is stored or is lying around. In this case, the slicer also poses a risk to children in particular.

In the case of the "Trend-Line" slicer, provision is made for the latter to be accommodated in a slicer holder which covers the blade from external access. The "V4" slicer provides for a position of the insert on the basic body in which the insert is in directly adjacent abutment against the cutting edge. In this securing position, the insert can even project some way beyond the cutting edge in order to reduce the risk of injury yet further.

BRIEF SUMMARY

The object of the present invention is to specify an improved reversible insert for a slicer, and a slicer having such an insert, where the risk of injury is reduced yet further. This object is achieved, in the case of the reversible insert mentioned in the introduction, in that the second fastening means are arranged such that, in the second reversal position, the insert covers the cutting edge of the blade from above.

In the case of the slicer mentioned in the introduction, the object is achieved by combining with such an insert. Significantly improved safeguarding against injury can be realized by the measure of arranging the second fastening means such that, in the second reversal position, the insert covers the cutting edge of the blade from above. Even if, in the second reversal position, someone pushes on the insert from above, the insert cannot be guided past the cutting edge in order to expose the latter. Rather, in the second reversal position, the insert is arranged such that it covers the cutting edge from above, so that it is not possible to gain access to the cutting edge.

It goes without saying that, in the second reversal position, the insert thus cannot be used for cutting purposes. In the second reversal position, the slicer having the insert can be stored without posing any risk of injury, for example in a drawer to which even children have possibly unsafeguarded access.

The object is thus achieved in full.

In the second reversal position, the insert preferably rests on the blade.

As a result, when pressure is exerted in the downward direction, the insert is supported on the blade and a situation where the insert is guided past the cutting edge, and exposes the latter, can be avoided.

According to a further preferred embodiment, the second fastening means are arranged such that, in the second reversal position, the base plate of the insert covers the cutting edge of the blade from above and/or rests on the blade.

In the case of this embodiment, the shape of the base plate may be adapted to the course followed by the cutting edge of the blade. Furthermore, there is no need for the insert to be provided with any dedicated attachment or section which is specifically designed for covering the blade from above in the second reversal position.

It is further preferred if the first fastening means are first latching means in order for it to be possible to secure the insert on the basic body with latching action in the first reversal position.

In a corresponding manner, it is preferred if the second fastening means are second latching means in order for it to be possible to secure the insert on the basic body with latching action in the second reversal position.

This simplifies the operation of the slicer and of the insert.

It is also advantageous if longitudinal-guidance means are provided in order for it to be possible to shift the insert longitudinally on the basic body of the slicer at least between a latching position and a release position.

Furthermore, it is advantageous if the second latching means have axial latching means in order to secure the insert longitudinally on the basic body with latching action.

This is advantageous, in particular, when the longitudinal-guidance means are also provided, so that the latching position can be achieved by a straightforward longitudinal movement of the insert on the basic body.

Furthermore, it is preferred if the second latching means have transverse stop means which, in the second reversal position, prevent movement of the insert on the basic body in a direction transverse to the cutting plane of the blade.

Provision may be made here for the transverse stop means to prevent movement of the insert in the downward direction. However, as an alternative or in addition, the transverse stop means may also be provided in order to prevent movement of the insert in an upward direction. It is possible here for the transverse stop means to form some of the second latching means, that is to say to serve for securing the insert on the basic body with latching action.

Overall, it is further advantageous if the first and the second fastening means are arranged on the insert at a spacing apart from one another in the cutting direction.

It is thus possible to use the same latching section on the basic body in each case for the first and the second reversal positions.

It is particularly preferred here if the positioning of the fastening means relative to one another is such that, in the second reversal position, the insert is displaced further forward, that is to say further in the direction of the blade, so that it can preferably cover over the latter.

In the first reversal position, the front edge of the insert, in contrast, is approximately aligned with the cutting edge, so that the cut-off slices can easily drop out in the downward direction.

Of course, the features which have been mentioned above, and those which are still to be explained hereinbelow, can be used not just in the combination specified, but also in other combinations, or on their own, without departing from the framework of the present invention.

BRIEF DESCRIPTION OF THE DRAWING

Exemplary embodiments of the invention are explained in more detail in the following description and are illustrated in the drawing, in which.

DETAILED DESCRIPTION

Figure 1:
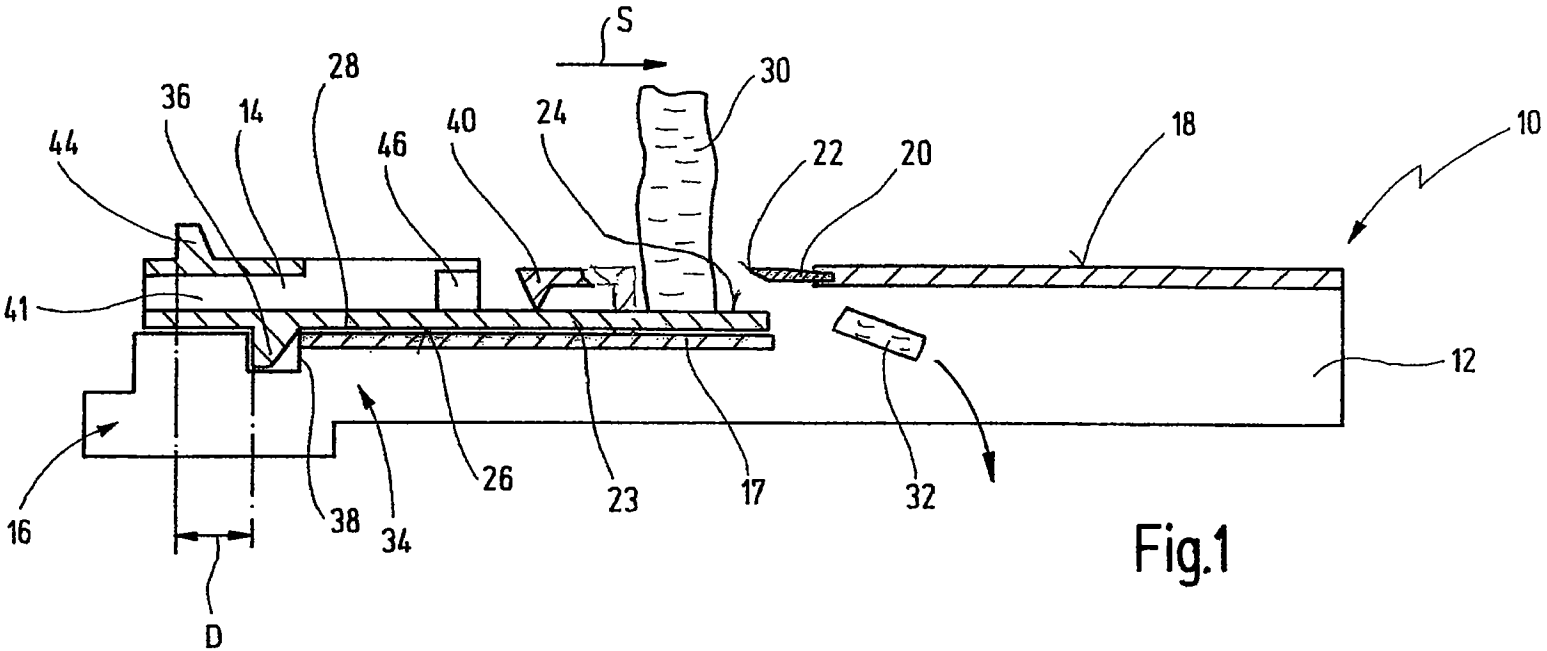
FIG. 1 shows a schematic sectional view of a first embodiment of a slicer according to the invention in a first reversal position.
Figure 2:
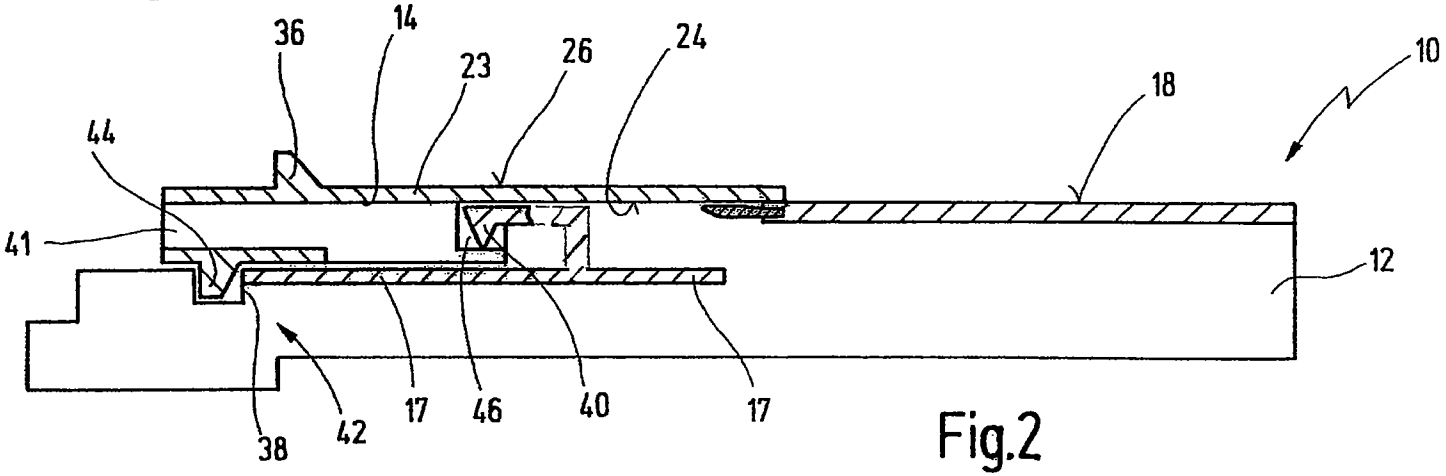
FIG. 2 shows a view of the slicer corresponding to FIG. 1, this time in the second reversal position.

In FIGS. 1 and 2, a first embodiment of a slicer according to the invention is designated in general terms by 10.

The slicer has a basic body 12 and an insert 14.

The basic body 12 and the insert 14 may be produced from plastic. As an alternative, it is also possible to produce the basic body 12 and the insert 14 from metal, e.g., stainless steel.

The basic body 12 usually has two parallel longitudinal supports. Between the longitudinal supports, a handle 16 is formed at the rear end. Following this, an accommodating plate 17 is provided between the longitudinal supports, an insert 14 for insertion into the basic body 12 being supported on this accommodating plate in a first reversal position. At the front end of the basic body, the longitudinal supports are connected to one another by a run-off surface 18. The run-off surface 18 is offset parallel to the accommodating plate 17. Arranged on the rear edge of the run-off surface 18 is a cutting blade 20, which may be, for example, a V-blade. The cutting edge of the blade 20 is illustrated at 22.

The insert 14 has a base plate 23. The top side of the base plate 23 is designed as a bearing surface 24. The underside 26 of the base plate 23, in the inserted state, rests on the top side 28 of the accommodating plate 17.

In order to cut or slice an item 30, the latter is moved forward from the rear in a direction S, while being pressed onto the bearing surface 24 in the process. In this case, slices 32 are cut off from the item 30 and the remaining portion of the item runs off on the run-off surface 18 as a continuation of the movement along the direction S.

This basic construction of the slicer 10 and the functioning thereof are known in general.

FIG. 1 illustrates the insert 14 in a first reversal position, in which the bearing surface 24 is arranged in relation to the blade 20 such that items 30 can be cut.

In the first reversal position, the insert 14 is latched on to the basic body 12 by means of a first latching device 34.

The latching device 34 contains a first nose 36 (as first latching means) on the underside of the base plate 23 of the insert 14. Provided on the basic body 12 is a corresponding depression 38, in which the nose 36 engages in the latching position. Also provided on the basic body 12 is a transverse stop 40, which is designed in order to fix the base plate 23 in a direction perpendicular to the cutting plane. In this case, the accommodating plate 17, together with the transverse stop 40, forms a kind of longitudinal guide. For insertion of the insert 14 into the basic body 12, the base plate 23 is guided in this longitudinal guide until the nose 36 latches into the depression 38. In this state, the insert 14 is mounted on the basic body 12 with latching action. For releasing the insert 14, the latter can be raised at the rear end, in order to free the nose 36 from the depression 38, and then pulled out in a rearward direction.

The nose 36, the depression 38 and the transverse stop 40 are each shown as individual elements. However, these elements are usually provided in the region of both the first and the second longitudinal support, so that the insert 14 is guided between the longitudinal supports.

FIG. 1 also shows that, starting from the base plate 23, at least one upwardly projecting crosspiece 41 is provided. The height of the crosspiece 41 corresponds approximately to the spacing between the base plate 23 and the blade 20.

Provided on the top side of the crosspiece 41 is a second nose 44, which is longitudinally spaced apart from the first nose 36 by a distance D.

The nose 44 forms second latching means of a second latching device 42, which secures the insert 14 on the basic body 12 with latching action in a second reversal position, as is illustrated in FIG. 2. In the second reversal position, the insert 14 is secured on the basic body 12 in a state in which it has been rotated through 180°. In this case, the second nose 44 engages in the depression 38. Also provided on the crosspiece 41 is a pocket 46, which accommodates the transverse stop 40.

In the second reversal position, that edge of the crosspiece 41 which is spaced apart from the base plate 23 rests on the accommodating plate 17, so that the base plate 23 is spaced apart from the accommodating plate 17 to the extent where it is located above the run-off surface 18, as is illustrated in FIG. 2.

As a result of the distance D, in the second reversal position, the insert 14 as a whole is secured further forward on the basic body 12, so that the base plate 23 covers the cutting edge 22 of the blade 20 from above, and more precisely rests on the blade 20. In the second reversal position, consequently, the slicer 10 cannot be used for cutting purposes. Rather, the second reversal position is a safety position, in which the insert 14 covers the blade 20 (and the cutting edge 22 thereof, respectively) from above.

Of course, in the case of a preferred configuration, one crosspiece 41 is provided on each of the sides of the base plate 23 and, correspondingly, a second nose 44 and a pocket 46 are provided on each crosspiece.

In this case, in the second reversal position, a space is formed between the base plate 23 and the accommodating plate 17, and this space can be used, for example, for accommodating further accessories for the slicer.

The insert 14 is released from the second reversal position, in turn, by the insert 14 being raised at the rear end, in order to free the second nose 44 from the depression 38, and by the insert 14 then being pulled out in the rearward direction, so that the pocket 46 is pulled away from the transverse stop 40.

Of course, the blade 20 may be a normal blade which is oriented transversely to the cutting direction S. However, the blade 20 may also be a V-blade which tapers in a V-shaped manner in the cutting direction S, as is known per se in the prior art.

The insert 14 can be used as an accessory for the applicant's "Trend-Line" slicer which is already known per se.

However, it is also conceivable for an embodiment of the insert according to the invention to be used in conjunction with the applicant's V4 slicer.

Instead of the insert 14 being secured on the basic body 12 with latching action, it is also possible for the insert 14 to be secured on the basic body 12 with clamping action in each case. This can be achieved by corresponding dimensioning of the insert 14 and of the basic body 12. In this case, there would be no need for the first and second latching means (depression 38 and noses 36 and 44).

Figures 3, 4:
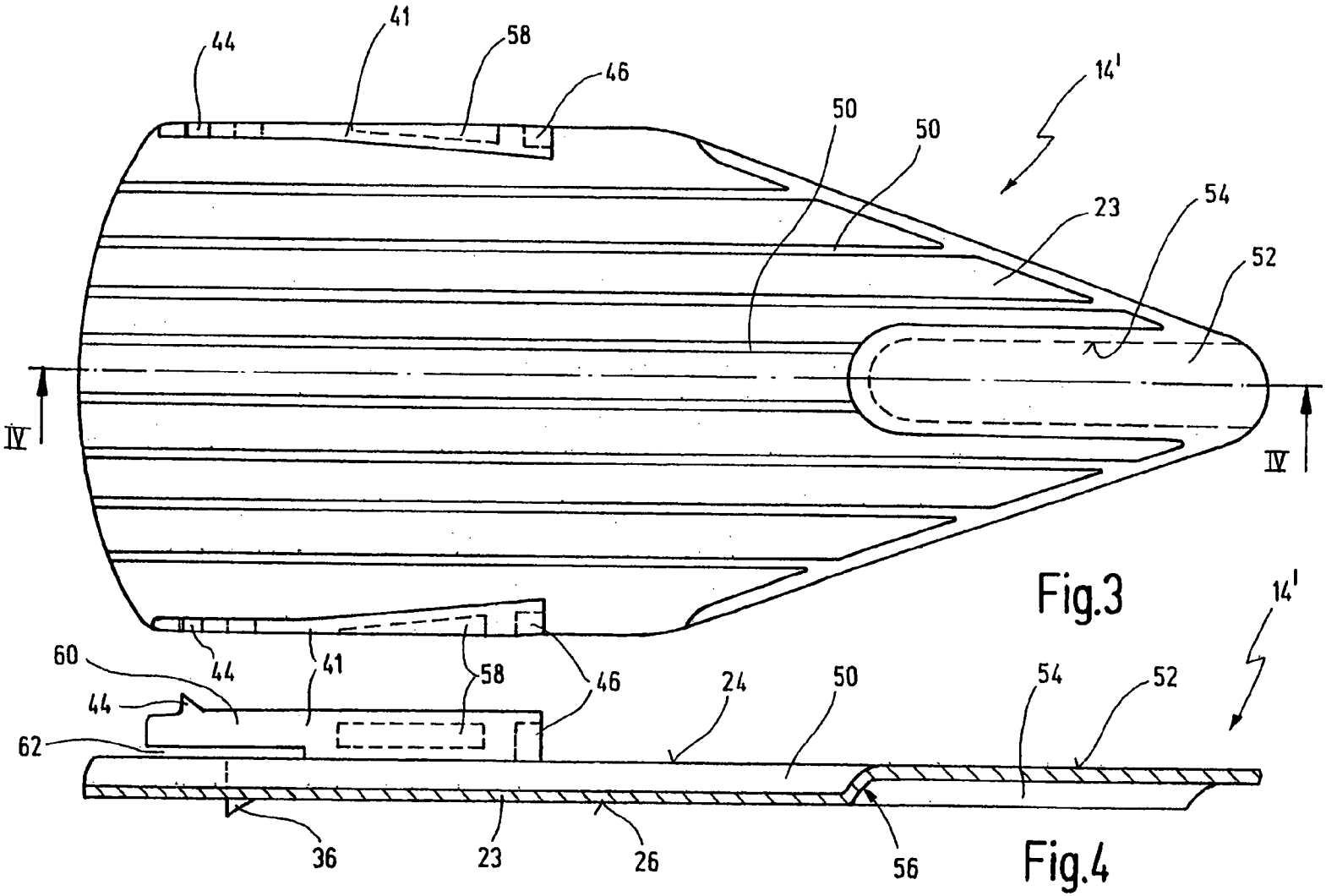
FIG. 3 shows a plan view of a further embodiment of an insert according to the invention for a slicer.
FIG. 4 shows a sectional view along line IV-IV in FIG. 3.

FIGS. 3 and 4 illustrate a further embodiment of the insert 14' according to the invention for a slicer. The general construction and the functioning of the insert 14' correspond to those for the insert 14 of FIGS. 1 and 2. For this reason, only the differences will be discussed hereinbelow. Furthermore, the same designations are used for the same elements.

The insert 14' of FIGS. 3 and 4 is designed, in particular, for use in conjunction with the applicant's "Trend-Line" slicer. The base plate 23 is provided with a plurality of ribs 50 extending in the cutting direction S. In this case, the top side of the ribs forms the bearing surface on which the item to be cut 30 is guided. The insert 14' tapers in a V-shaped manner in the front region. Provided in the region of the tip of the V is an elliptical surface, of which the top side is aligned with the top side of the ribs 50.

An approximately finger-sized depression 54 is thus formed beneath the elliptical surface 52. This depression can be used for releasing the insert 14' from the second reversal position in the associated basic body by virtue of pressure being applied against a slope 56 which is formed between the elliptical surface 52 and the base plate 23.

The pockets 46 are provided laterally on the outside of the crosspieces 41, so that they can accommodate within them the transverse stops 40, which are provided on inner lateral surfaces of the two longitudinal supports of the basic body (not shown).

The crosspieces 41 diverge conically in the forward direction in order to provide, in the region of the pockets 46, a sufficient volume for forming the latter. For injection-molding reasons (the insert 14' is produced from plastic), further lateral recesses 58 are provided in the crosspieces 41.

In the rear region, the crosspieces are spaced apart from the base plate 23 by slots 62, so that, in their rear region, the crosspieces 41 are formed in the manner of a tongue 60. This facilitates handling since the second nose 44 is formed on the tongue 60 and can thus be shifted more easily into the latching position.

I claim:

1. A slicer, comprising:

a slicer body having a depression therein;

a blade having a top surface, a bottom surface, and a cutting edge, wherein the bottom surface of the blade faces the slicer body;

a reversible base plate having a first surface and a second surface opposed to one another, wherein the reversible base plate is designed to be removably secured to the slicer body in one of a first reversal position and a second reversal position, wherein the reversible base plate in the first reversal position and in the second reversal position is substantially parallel to the blade, wherein the reversible base plate includes a first nose on the first surface and a second nose on the second surface;

a first fastening means that removably secures the reversible base plate on the slicer body in the first reversal position and comprises the first nose, wherein in the first reversal position, the first nose of the base plate is removably engaged with the depression of the slicer body; and a second fastening means that removably secures the reversible base plate on the slicer body in the second reversal position and comprises the second nose, wherein in the second reversal position, the second nose of the base plate is removably engaged with the depression of the slicer body and the reversible base plate covers the entire cutting edge of the blade.

2. The reversible base plate as claimed in claim 1, wherein, in the second reversal position, the reversible base plate rests on the blade.

3. The reversible base plate as claimed in claim 1, wherein the first fastening means are first latching means in order for it to be possible to secure the reversible base plate on the slicer body with latching action in the first reversal position.

4. The reversible base plate as claimed in claim 1, wherein the second fastening means are second latching means in order for it to be possible to secure the reversible base plate on the slicer body with latching action in the second reversal position.

5. The reversible base plate as claimed in claim 1, comprising longitudinal-guidance means in order for it to be possible to shift the reversible base plate longitudinally on the slicer body at least between a latching position and a release position.

6. The reversible base plate as claimed in claim 1, wherein the second latching means have axial latching means in order to secure the reversible base plate longitudinally on the slicer body with latching action.

7. The reversible base plate as claimed in claim 1, wherein the second latching means have transverse stop means which, in the second reversal position, prevent movement of the reversible base plate on the slicer body in a direction transverse to the cutting plane of the blade.

8. The reversible base plate as claimed in claim 1, wherein the first and the second fastening means are arranged on the reversible base plate at a distance apart from one another in the cutting direction.

9. The slicer as claimed in claim 1, wherein the slicer body comprises a transverse stop and an accommodating plate that together form a longitudinal guide designed to guide the reversible base plate into place.

10. The slicer as claimed in claim 9, wherein the reversible base plate comprises a pocket that accommodates the transverse stop when the reversible base plate is in the second reversal position.

11. A slicer for chopping up items, comprising:

a basic body having a blade including a cutting edge provided on a top surface of the blade, wherein the top surface faces away from the basic body; and a reversible insert substantially parallel to the blade, the insert having a base plate with first and second opposing sides, wherein the first side, in a first reversal position, is a bearing surface on which the item to be chopped is guided longitudinally toward the cutting edge of the blade, the insert having first fastening means in order for the insert to be removably secured on the basic body of the slicer in the first reversal position, and having second fastening means in order for the insert to be removably secured on the basic body in a second reversal position, wherein the second fastening means are arranged such that, in the second reversal position, the insert covers the entire cutting edge of the blade.

* * * * *